US006270838B1

(12) United States Patent
Wallace et al.

(10) Patent No.: US 6,270,838 B1
(45) **Date of Patent: *Aug. 7, 2001**

(54) SELF LOCKING INTERNALLY THREADED FASTENER AND APPARATUS AND PROCESS FOR MAKING THE SAME

(75) Inventors: John S. Wallace, Bloomfield Village, MI (US); Mahmoud Arslanouk, Haledon, NJ (US)

(73) Assignee: ND Industries, Inc., Clawson, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/553,763

(22) Filed: Apr. 21, 2000

Related U.S. Application Data

(60) Continuation of application No. 08/810,243, filed on Mar. 3, 1997, now Pat. No. 6,063,437, which is a division of application No. 08/285,547, filed on Aug. 3, 1994, now Pat. No. 5,607,720.

(51) Int. Cl.[7] ..... B05D 3/12; B05D 7/22

(52) U.S. Cl. ..... 427/181; 427/195; 427/235; 427/239

(58) Field of Search ..... 427/181, 195, 427/198, 235, 239, 348, 385.5

(56) References Cited

U.S. PATENT DOCUMENTS

| | | | |
|---|---|---|---|
| 3,294,139 | | 12/1966 | Preziosi . |
| 3,416,492 | | 12/1968 | Greenleaf . |
| 3,830,902 | * | 8/1974 | Barnes . |
| 3,975,787 | | 8/1976 | Newnom . |
| 3,995,074 | | 11/1976 | Duffy et al. . |
| 4,035,859 | | 7/1977 | Newnom . |
| 4,262,038 | | 4/1981 | Wallace . |
| 4,279,943 | | 7/1981 | Wallace . |
| 4,366,190 | | 12/1982 | Rodden . |
| 4,865,881 | * | 9/1989 | Sessa et al. . |
| 5,090,355 | | 2/1992 | DiMaio et al. . |

* cited by examiner

*Primary Examiner*—Frederick J. Parker
(74) *Attorney, Agent, or Firm*—Liniak, Berenato, Longacre & White, LLC

(57) ABSTRACT

A method for making a self locking internally threaded fastener and an apparatus for making such fasteners, in which the self locking characteristic is derived from a patch of thermoplastic material having a circumferential extent of less than 360° adhered selectively to at least a portion of the thread defining surface of the fastener.

11 Claims, 4 Drawing Sheets

SELF LOCKING INTERNALLY THREADED FASTENER AND APPARATUS AND PROCESS FOR MAKING THE SAME

This application is a continuation of application Ser. No. 08/810,243 filed on Mar. 3, 1997, now U.S. Pat. No. 6,063,437, which was a divisional of application Ser. No. 08/285,547 filed on Aug. 3, 1994; now U.S. Pat. No. 5,607,720.

BACKGROUND OF THE INVENTION

This invention relates to fasteners and is more specifically related to internally threaded fasteners having self locking patches of thermoplastic material adhered to at least a portion of the threads thereof.

Self-locking fasteners of the type in which the self-locking characteristic is derived from a coating such as a patch material adhered to all or a portion of the thread defining surface of the fasteners have proven to be very popular for a wide variety of applications, in order to prevent loosening of the fastener due to vibration and the like in various applications. The prior art discloses various methods and apparatus for applying locking patches of resilient resin or thermoplastic type material to threaded articles. Many of these teachings, however, have proven to be effective only for coating externally threaded fasteners with patches of resilient material and do not find application when it comes to applying such patches on internally threaded fasteners to make them self-locking. To attempt to utilize many of these continuous powder feed type systems with internally threaded fasteners would result in the unwanted coating of surfaces other than the threaded portion of such fasteners.

The problem of providing a coating that will act as a self-locking element to the threads of an internally threaded article such as a nut has presented many difficulties. Such an article may be a friction nut capable of producing a fluid tight seal or the like. A suitable coating for this purpose may be any of numerous resins, such as nylon or other thermoplastic resins. Prior art references that have addressed the problem of forming self locking patches on internally threaded fasteners, have frequently required heating of the fastener to at least about 450° F., prior to directing the thermoplastic material towards the threads to form the self-locking patch.

To insure proper adhesion of the thermoplastic material to the threads with these types of processes, it was also necessary to include an epoxy resin component in the material. Since the entire fastener was preheated to a temperature significantly above the melting point of the thermoplastic resin, great care was required to be used in order to insure that the thermoplastic resin came into contact only with the precise portion of the internal threads of the fastener that was desired to be covered and nowhere else. Otherwise, upon application the resin would tend to adhere to other surfaces of the fastener, causing cosmetic problems, overspray and also improper and inconsistent torque values for the finished self-locking product.

To overcome this problem, various, rather complicated devices were developed. Some devices interrupted the stream of thermoplastic material at regular intervals or indexed the flow of material to coincide with a succession of fasteners passing by the powder supply station. Other systems have utilized special nozzles that were at least partially inserted into the openings of the internally threaded fasteners on a reciprocating basis, to attempt to more precisely control the deposition of powder onto only the desired number of threads and about a desired circumference. Many of these prior art devices also required a large number of powder supply tubes or nozzles in order to provide a separate nozzle for each internally threaded fastener to be coated, such as taught in U.S. Pat. No. 4,366,190. This became particularly troublesome, considering that these systems traditionally required the powder to be entrained in an airstream in order to be directed towards the fasteners.

An additional drawback to such methods and apparatus was presented as a result of the use by these systems of a recirculating powder feed system. Whatever excess thermoplastic powder was directed towards the internal threads of the fastener that did not adhere thereto was frequently, entirely or partially melted as it passed by the highly heated fastener. This resulted in particles fusing together and being recirculated into a powder feed system and then potentially agglomerating even further with other particles. This caused an uneven powder flow of particles of different size, diameter and character to be directed towards subsequent heated fasteners. This resultant variation, combined with pulsing of the airstream entrained powder flow, due to agglomeration of the powder from moisture or the presence of other contaminants, lead to significant variations in torque values of the self locking fasteners and also a shortened useful life of the powder that was recirculated.

Certain disadvantages have also been experienced with other known methods and apparatus to form resilient thermoplastic patches on internally threaded fasteners that do not require the fasteners to be heated prior to application of the patch material. For example, U.S. Pat. No. 4,262,038 discloses a method of producing coated internal threads of a fastener that is only capable of producing a 360° coating and necessitates completely filling the internally threaded opening of the article throughout the complete 360° circumferential extent thereof between the ends, with the thermoplastic resin prior to heating the fastener. This method is slow since it requires the entire cavity of the internally threaded fastener to be filled with powder, even though the vast majority of the powder is not utilized in the coating. Also, this method does not provide for formation of a patch that would either be less than 360° in circumference, or cover fewer than all of the threads of the fastener.

Other prior art systems that do not heat internally threaded fasteners prior to the deposition of the resilient powder present other shortcomings. The system taught in U.S. Pat. No. 3,830,902, requires each fastener to be coated to be placed upon a pin which masks a greater portion of the thread defining surface and establishes a cavity which permits the deposit of plastic powder upon a limited portion of the threads, resulting in the establishment of a plastic patch of limited axial and circumferential extent. These pins require a certain amount of spacing between each successive pin in order to properly position and remove the nuts. It was found that the use of pins upon which fasteners are seated during establishment of plastic patches on the fasteners in such systems was problematic. The pins would wear allowing uncontrolled distribution of powder upon the thread defining surface, even to the extent that the desired clear lead-on thread had not been preserved.

In addition, the limited circumferential extent of a plastic patch produced by such systems provides only a concomitant limited area of adherence between the patch and the threads of the fastener. Thus, where the presence of foreign matter such as water or oil at the interface between the patch and thread defining surface tends to come between the patch and the area of the surface to which the patch adhered, total adherence is diminished sometimes to an unacceptable level.

These systems also required use of a powder distribution means that had a continuous flow that had to be indexed with the fasteners travelling thereunder to provide for powder flow only when the threaded surface of the fastener passes below the powder distribution means.

While the prior art systems, referred to above, have proven to be at least somewhat successful in achieving the objects for which they were intended, it has become desirable to have an improved method and apparatus which offers equal or superior speed and quality over existing systems for applying resilient self locking patches to internally threaded fasteners that does not require preheating of the fasteners prior to application of self locking materials, indexing of the fasteners, indexing or interruption of the powder stream to the fasteners, multiple, intricate or reciprocating nozzles for powder deposition, an airstream to be combined with the powder delivery system or the use of powders that have a resin included therein.

While the present invention will be described particularly with respect to applying heat softenable thermoplastic particles to the threads of internally threaded articles, it is to be understood that apparatus and process of the present invention can be used to apply a variety of materials, including resins and resin compounds and pure nylon.

It is therefore an object of the present invention to provide an improved method and apparatus for the manufacture of self locking internally threaded elements wherein the self locking feature is obtained through a thermoplastic deposited onto a selected portion of the internal threaded surface of the element.

Another object of the present invention is to provide an improved method and apparatus for the manufacture of self locking internally threaded elements wherein improved control of the application of the locking body of thermoplastic and thermoplastic application is obtained over a desired arcuate and vertical area of the internal threads of the element and preheating of the fastener is not required.

Yet another object of the present invention is to provide an improved method and apparatus for the manufacture of self locking internally threaded elements wherein the powder flow through the output of the powder delivery system to the elements is continuous and uninterrupted.

Still another object of the present invention is to provide an improved method and apparatus for the manufacture of self locking internally threaded elements that achieves substantially equal results in terms of locking ability regardless of whether the powder used is a resin or has an epoxy constituent.

A further object of the present invention is to provide a method and apparatus for the manufacture of self locking fasteners that allows for greater reusability and more economical use of coating powder.

A still further object of the present invention is to provide a method and apparatus for the manufacture of internally threaded self locking fasteners that utilizes a continuously moving conveyor belt with the internally threaded fasteners delivered onto the belt such that one of the external faces of the nut is in substantially complete contact with the upper surface of the conveyor belt and a portion of one of the sides of the nut is also supported.

SUMMARY OF THE INVENTION

The above objects and other objects which will become apparent after a reading of the detailed description of this invention are achieved by a method for applying a locking element of thermpolastic type material to a succession of internally threaded articles having open ends to the threaded portion thereof that includes the steps of conveying the threaded articles on a support in a path for treatment with the axes of their threaded portions in a substantially horizontal position and with their openings at the threaded portions uncovered, directing a continuous uninterrupted stream of thermoplastic type material onto and around an area of each of the threaded portions in an amount in excess of the amount needed to form the locking elements, removing the amount of thermoplastic type material in excess of the amount required to form the locking element from around the area of each of the threaded portions and from the threaded portions of each of the articles, and thereafter heating the threaded portions of the threaded articles to a temperature above the softening point of the thermoplastic type material to be applied.

DETAILED DESCRIPTION OF THE INVENTION

Figure 7:
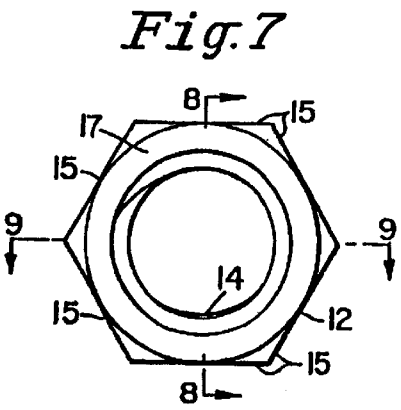
FIG. 7 is a plan view of a threaded fastener shown in the form of a nut constructed in accordance with the teachings of the present invention.
Figure 8:
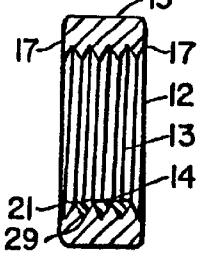
FIG. 8 is a cross sectional view taken along the line 8—8 of FIG. 7.
Figure 9:
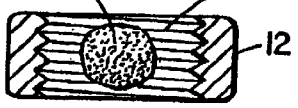
FIG. 9 is a cross sectional view taken along the line of 9—9 of FIG. 7.

Referring now to the drawings, and in particular FIGS. 7–9, a typical internally threaded fastener is illustrated that has been processed in accordance with the apparatus and methods of the present invention. This fastener 12, is illustrated as exemplary of only one of the many different types of internally threaded fasteners that could be processed in accordance with the present invention and has six external sides 15 and two opposing faces 17. The fastener 12 also has internal threads 13 and a self-locking patch 14 of applied resilient material 38. In accordance with the present invention, this patch 14 can be accurately positioned and deposited on a selected number of threads 13 of a fastener 12 along a selected arc and at a selected thickness more economically, quickly and accurately than existing methods and apparatus for forming such patches on internally threaded fasteners. It should be noted that, as illustrated in FIG. 8, patch 14 when adhered to a selected number of threads 13, is thicker in the region of the thread valleys 29 than in the area of thread crests 21 and tends to loosely follow the contour of the threads 13.

Figure 1:
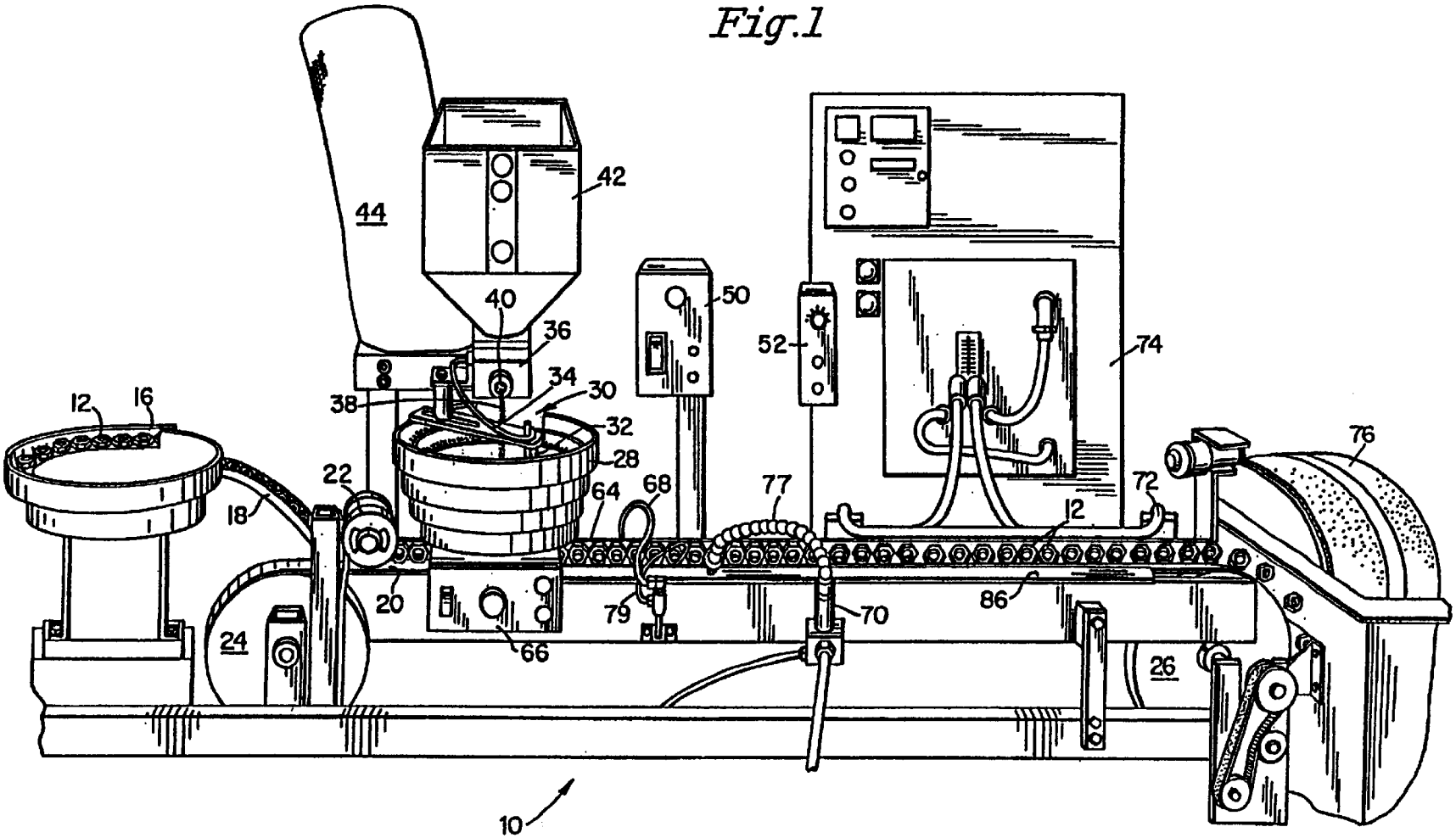
FIG. 1 is a perspective view of an embodiment of an apparatus for the manufacture of self locking internally threaded fasteners in accordance with the present invention.

Referring now to FIG. 1, the apparatus 10 of the present invention is generally disclosed. The apparatus 10 includes a continuous conveyor belt 20 that is preferably constructed of a material that is capable of withstanding significant repeated exposure to heating, such as fiberglass. The belt 20 is wider than the width of one of the external sides 15 of the fasteners such as fastener 12 that can be processed in accordance with the present invention. The belt 20 is driven by a belt drive system that features conveyor systems 24 and 26 that continuously circle the belt 20 at an adjustable pre-selected speed preferably on the order of 10–20 feet per minute, in accordance with the self-locking processing to be completed by the apparatus 10.

As illustrated in more detail in FIGS. 1–6, during all times that fasteners 12 are present on the belt 20, at least a portion of one of the external sides 15 of each fastener 12 is in contact with the surface of the belt 20. Also, during the entire time that fasteners 12 are in contact with the belt 20, at least a portion of the outer face 17 of each of the fasteners 12 is in contact with the guide bar 64. The guide bar 64 provides a slick heat resistant surface to support and orient the fasteners 12 that are to be processed. The guide bar 64 is preferably of a height equal to or greater than the height of fasteners 12 to be processed, measured from one outer face 15 to a 180° opposing outer face 15. The guide bar 64, as previously mentioned, must provide a non-stick heat resistant support surface for the fasteners 12. Although a variety of materials are suitable for construction of the guide bar 64, it has been found particularly preferable to utilize a fiberglass or fiberglass reinforced material with a Teflon coating to achieve superior results.

As particularly illustrated in FIGS. 3–6, guide bar 64 is spaced horizontally a distance from the conveyor belt 20. The space 54 between the guide bar 64 and the conveyor belt 20 is at its minimum, as indicated at W1 in FIG. 3, at a point where fasteners 12 are first introduced onto the conveyor belt 20. The space 54 between the guide bar 64 and conveyor belt 20 then continuously increases to a maximum spacing or width as represented at W2 in FIG. 3, which is in the region where fasteners 12 processed with self-locking patches 14 in accordance with the present invention are exited from the conveyor belt 20 for the purpose of collection.

Device 10 is also provided with a belt rail 86 which runs substantially the entire length of the conveyor belt from the region where resilient thermoplastic material 38 is applied to the fasteners 12 to the region where the fasteners 12 are exited off of the conveyor belt 20. The belt rail 86 serves to shield the drive means of conveyor belt 20 from resilient thermoplastic material 38 and further serves to shield the belt 20 from the operator.

The improvements of the present invention are more readily appreciated by tracing the path of fasteners through the apparatus 10. Fasteners 12 are required to be presented to the conveyor belt 20 in a uniform closely spaced manner. Any of a number of different known types of parts feeding mechanisms, such as vibratory parts feeder 16, can be used to accomplish this purpose. The feeder 16 arranges and moves fasteners in a manner to deposit them continuously and uniformly onto the orienting track 18. Fasteners 12 are first deposited onto the orienting track 18 in a closely spaced continuous fashion with one of the fastener surfaces 17 resting against the bottom 33 of the orienting track 18. As the fasteners 12 move down the orienting track 18 towards the conveyor belt 20, the fasteners 12 are rotated to a different orientation such that they are substantially resting on one of the fastener outer faces 15. The fasteners 12 then pass under guide roller 22 and are thereby urged onto the conveyor belt 20 such that a portion of one of the outer faces 15 of each fastener 12 is in contact with the top surface 19 of the conveyor belt 20 and a portion of one of the surfaces 17 of each fastener 12 is in contact with the guide bar 64.

When the fasteners 12 are first introduced onto the conveyor belt 20 and are moved into the region of the powder delivery chute 62, they continue to be in a substantially upright orientation wherein all of one of the outer faces 15 of each fastener 12 is either in contact with or very close to the top surface 19 of the conveyor belt 20 and the fastener opening 25 is substantially parallel to the top surface of the conveyor belt 20. This orientation can be readily seen with reference to FIGS. 3 and 4, wherein the angle a1 is very small. The preferred range of values for the angle a1 is between about 1° to 20°.

Figure 2:
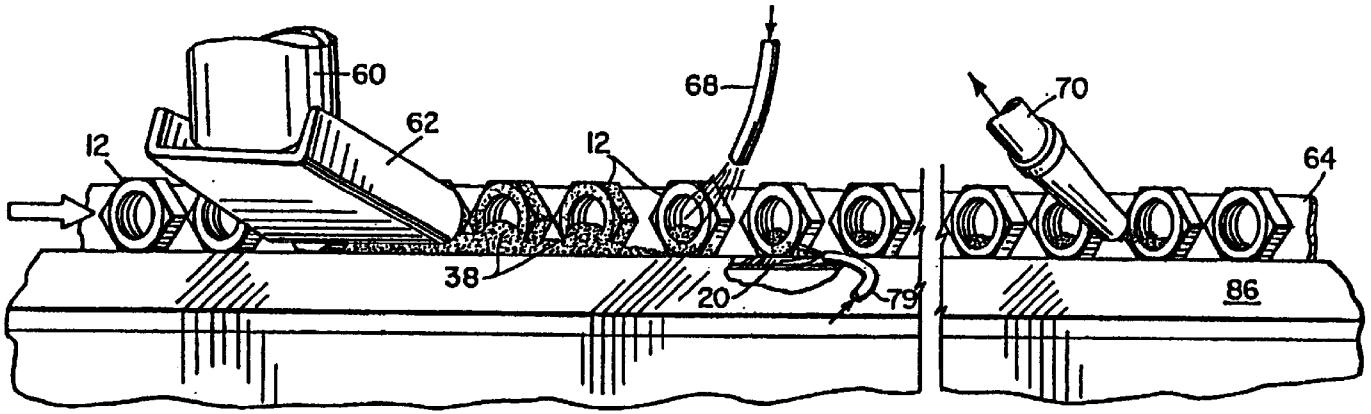
FIG. 2 is a fragmentary perspective view of a portion of the path that fasteners travel in accordance with one embodiment of the present invention.
Figure 5:
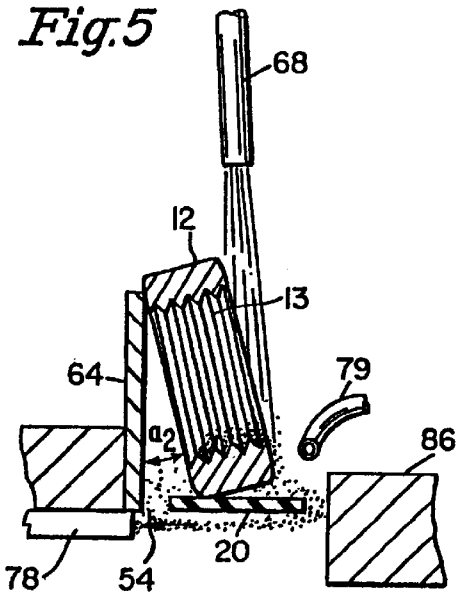
FIG. 5 is a partial cross sectional view of a single fastener as it passes through a powder removing airstream of the present invention.
Figure 6:
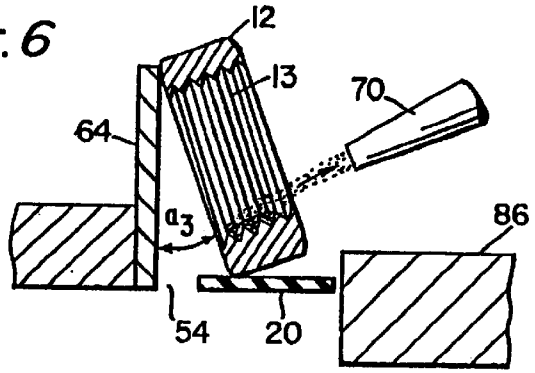
FIG. 6 is a partial cross sectional view of a single fastener as it passes through a powder removing suction device of the present invention.
Figure 4:
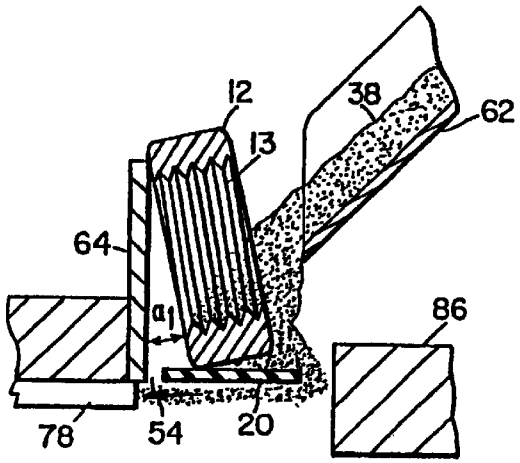
FIG. 4 is a partial cross sectional view of a single fastener as it passes through the powder applicator of the present invention.

The increase in the size of the gap 54 as the fasteners 12 traverse the length of the belt 20 causes a slight rotation of the fasteners 12 due to an increase in the value of angle a1 first to a2 and then ultimately to a3 as indicated in FIGS. 4–6. The preferred range of values for the angle a3 is between about 10° and 30°. As best illustrated in FIGS. 2 and 4, as fasteners 12 move along the conveyor belt 20 and pass in front of the powder delivery chute 62 each fastener 12 encounters a continuous flow of powdered resilient thermoplastic material 38 that is deposited around, on and in a circumferential portion of the threads 13 of each fastener 12 in an amount greater than that required to form the desired patch 14 of resilient thermoplastic material 38.

As previously mentioned and as will be discussed hereafter in much greater detail, the powdered resilient thermoplastic material 38 is deposited onto a portion of the threads 13 of each fastener 12 from the powder delivery chute 62, without the necessity of the material 38 being combined with or entrained in an airstream. Rather, the powder material 38 is delivered down the powder delivery feeder pipe 60 from the powder feeder exit area 58 under the force of gravity alone. It is preferred that the exit end of the delivery chute 62 be positioned such that the delivery of powder material 38 onto the threads 13 of the fasteners 12 is angled. It has been found that powder delivery has been best when angles of the chute 62 and delivery of the powder material 38 are close to 45° to the outer face 15 of the fastener 12 that is in contact with the top of the conveyor belt 20. The chute 62 is constructed so that its angle of delivery of powdered material in relation to the outer face 15 of the fastener 12 passing by it can be adjusted depending upon the processing that is desired.

As the fasteners continue their traverse down the conveyor belt 20, they next encounter one or more airstreams designed to shape and position the powdered resilient thermoplastic material 38 in an amount and in a way to produce the desired resilient thermoplastic patch 14 on the threads 13 of the fasteners 12 and remove. These airstreams also serve to recirculate all excess powdered resilient thermoplastic material 38 that was initially deposited to allow it to be ultimately delivered to other fasteners 12.

It should be understood that the embodiments illustrated of various airstream configurations to be used in positioning and shaping the material 38 and removing the excess material 38 are only exemplary and that more or fewer airstreams could be used and their orientations could be changed. The airstreams used could also be either all air blowing or all air vacuum streams or a combination thereof and still be within the scope of the present invention. Additionally, the present invention also contemplates locating one or more airstreams in front of or behind the belt 20, on top of or below the belt 20 and/or at any angle to the belt 20. Given this, the particular embodiment illustrated in FIGS. 1–6 will now be described in detail.

As illustrated in detail in FIGS. 2 and 5, an airstream issuing from a device such as a nozzle 68 is used for removing all powder from the lead thread as is required in many specifications for applying the patches 14 to fasteners 12. In addition, when angled properly, the airstream issuing from the nozzle 68 can be quite effective in removing the powdered material 38 from unwanted areas such as the fastener surfaces 17 and the conveyor belt 20. By acting in conjunction with a vacuum system stray material 38 and material 38 moved by the airstream is drawn into the vacuum nozzle 78 and then the powder return tube 84. In this manner, the excess material 38 can then be recirculated for ultimate deposition onto additional fasteners 12.

Figure 3:
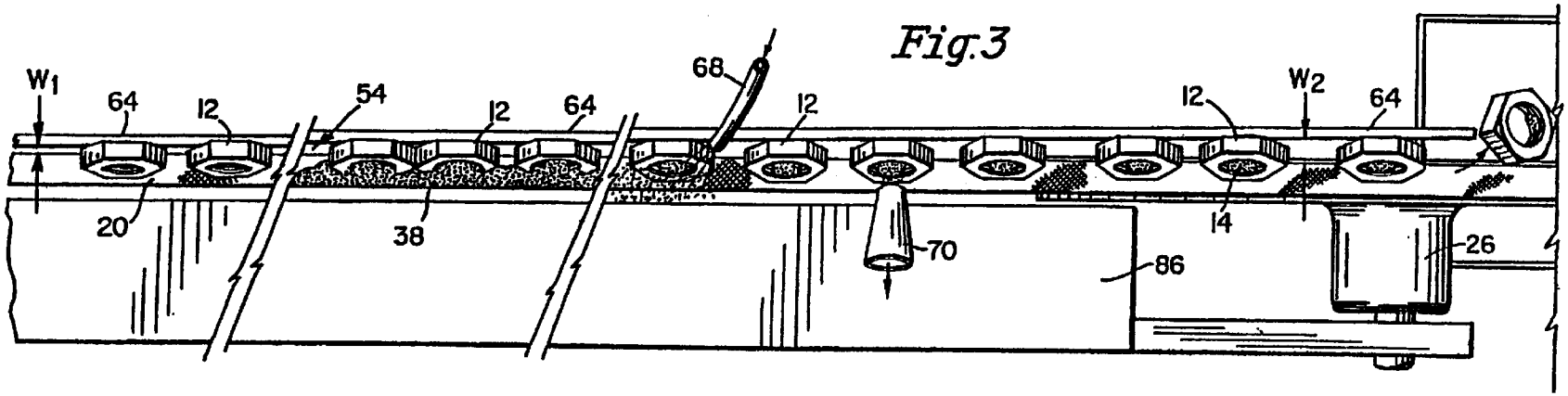
FIG. 3 is a fragmentary top view of a portion of the path that fasteners travel in accordance with one embodiment of the present invention.

As illustrated in FIGS. 3 and 5, as a result of this slight rotation of the fastener 12 on the conveyor belt 20 to the angle a2, it becomes easier to direct an airstream, such as that supplied by nozzle 68, to clear the lead thread of the fastener 12. This rotation also assists in clearing the areas of the conveyor belt 20 that are not in contact with the fastener 12. The clearing of the belt 20 is further accomplished by an additional airstream issuing from tube 79 in which thermoplastic material 38 dislodged by the airstream issuing from the tube 79 is collected for recirculation by vaccum nozzle 78 located on the opposite side of fastener 12 from tube 79. Both nozzle 68 and tube 79 can be of any standard design and could be either rigid or flexible. Preferred constructions include ⅛" copper tubing, nozzles having a single slotted opening, nozzles having a face perforated with a plurality of small openings and open ended flexible plastic tubes. Nozzle 68 and tube 79 are movably attached to apparatus 10 to allow for easy removal or adjustment depending upon the type of fasteners to be processed.

Once the fastener 12 has passed the airstream issuing from tube 79, it then encounters another airstream, such as that supplied from air vacuum 70. As the fasteners travel along conveyor belt 20 and encounter the air vacuum 70, they are rotated further on the conveyor belt 20, to the increased angle designated as a3 in FIG. 6. The rotation of the fastener 12 to the angle a3 allows for a relatively easy removal of excess powdered material 38 from the conveyor belt 20 and fastener surfaces 17 and outer faces 15. Alternatively this angle of rotation of fastener 12 also allows for removal and shaping of the material 38 in the area of threads 13 without disturbing the powder material 38, at the desired location of the threads where the patch 14 is to be located. Air vacuum 70 is utilized to remove powder from a region parallel to the nozzle, as illustrated in FIG. 6. The force of flow through air vacuum 70 is controlled by air vacuum control 52. Although a variety of different air pressures can be used to create a vacuum, the most preferred ranges of air pressure have been found to be on the order of approximately two inches of mercury.

As illustrated, air vacuum 70 can be used in conjunction with another vacuum system that directs stray powder material 38 into vacuum nozzle 88 and recirculating tube 90, for ultimate redeposition onto additional fasteners 12. Likewise, the powder material 38 that is removed with by air vacuum 70 is recirculated for ultimate redeposition onto additional fasteners 12.

Once the fasteners 12 leave the area of air vacuum 70, they continue along the conveyor belt 20 and pass through a heater 72. By the time of entry into the heater 72, only the powdered material 38 that is necessary and desirable to form the desired patch 14 remains in the area of the threads 13 of each fastener 12, and substantially all of the excess powdered material 38 that was initially deposited and, either on or around the fastener 12, has been removed and recirculated.

As the fasteners 12 traverse along the conveyor belt 20, through the heater 72, the fasteners are raised to a temperature sufficient to cause the powdered material 38 to adhere to the threads 13 of the fasteners 12 and to be fused by heat from the threaded surface 13 to form a continuous plastic body thereon. In order to cause sufficient adherence of the material 38, it is preferable to use the heater 72 to raise the temperature of the fasteners 12 above the melting point of the material 38. A preferred way of accomplishing this is by use of a high frequency 200 kilohertz induction heater. Although this heater is most preferred, those of a 30 kilohertz frequency or higher are sufficient in most instances to produce a suitable amount of heat. Once the fasteners 12 exit the heater 72, they begin to cool and are exited off of the conveyor belt 20 using any of a number of known parts removal systems, such as the one illustrated at 76.

The present invention necessitates a lesser degree of heating than prior art processing systems that directed powdered thermoplastic material against fasteners that had been preheated to a temperature sufficient to cause the material to adhere to the threaded surface of the fasteners. This is because in the present invention all of the thermoplastic powdered material that will ultimately form the patch is already deposited and resting in the threaded area of the fastener prior to heating of the fastener. The heat applied thereafter need only be great enough to cause the thermoplastic powder to adhere to threads of the fastener and coalesce and fuse the material to form a continuous plastic body.

In contrast, prior art systems required increased heating of the fasteners to enable not only adherence and fusing of the material into a continuous plastic body, but also the initial catching and softening of individual particles from a stream of the particulate material that was directed toward the threads of the fasteners. Since the present invention does not have to catch particles from a stream directed toward the threaded surfaces of fasteners it also either substantially lessens or in some cases eliminates the need for a primer or tying agent such as a thermosetting epoxy resin powder to be combined with the thermoplastic particles of the locking element. This results in a significant potential cost savings without sacrificing adherence and torque values of the finished patch.

The unique powder feed system of the present invention will now be described in more detail. Referring to FIGS. 1, 2, 10 and 11, powdered material 38 is contained in the powder supply bin 42 and is exited from the powder block 36 by auger 40 that urges powder material 38 out through an opening in the block 36. The auger 40 is rotated in response to the optical sensor assembly 30, which is connected to the powder block 36 and is positioned partly within the vibratory powder feeder 28.

The optical sensor arm 34 holds and connects the optical sensor 32, which extends into the vibratory powder feeder 28. The optical sensor 32 is directed toward the bottom 56 of the powder feeder 28. If the optical sensor 32 senses that an insufficient amount of powdered material 38 is present in the bottom 56 of the feeder 28, then it causes the auger 40 to move in the powder block 36 and force more powdered material 38 to drop into the bottom 56 of the feeder 28. The sensor 32 provides very precise control over the amount of powdered material 38 in the bottom 56 of the feeder 28 in order to keep the level virtually constant. Although many different photoelectric sensors can be used, a particularly preferred sensor, for the purposes of this invention, was found to be an OMRON photoelectric switch (Model E3A2-XCM4T).

Figure 11:
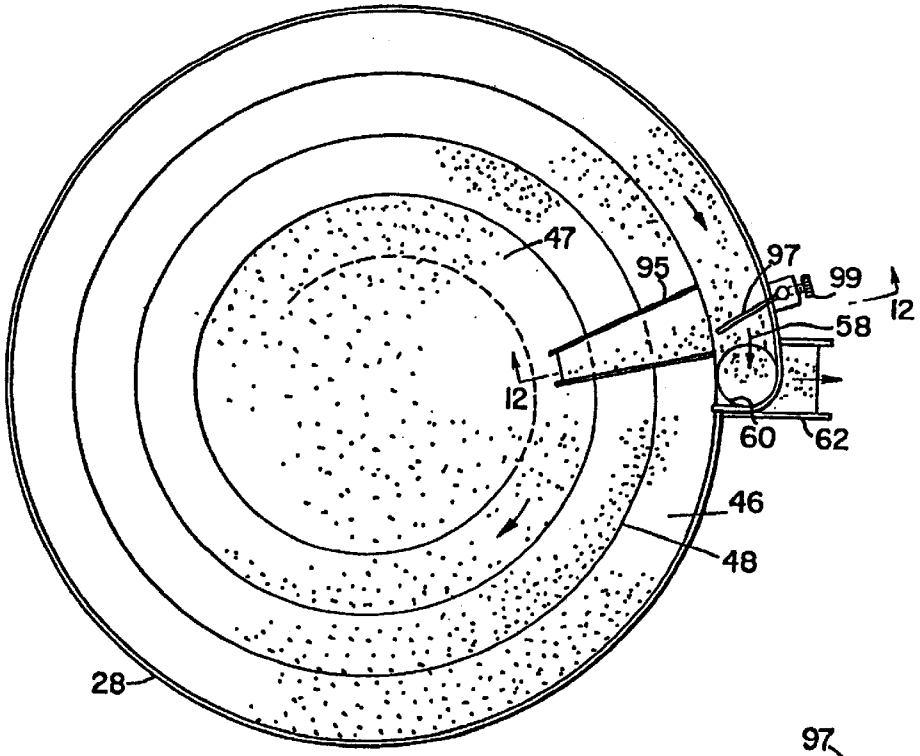
FIG. 11 is a top view of the powder feeder and powder sensor of the present invention.
Figure 12:
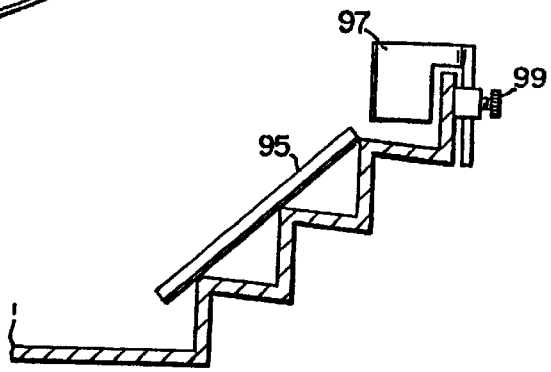
FIG. 12 is a partial cross sectional view of the powder feeder of the present invention taken along the line 11—11 of FIG. 12.

The vibratory powder feeder 28 is of a stepped construction, in the nature of an inside track cascading vibratory bowl. The feeder 28 is vibrated and controlled by a variable speed DC motor such as an FMC Centron controller. As illustrated in FIGS. 11 and 12, the vibratory action of the motor upon the feeder 28 causes powder material 38 deposited initially at the bottom 56 of the feeder 28 to move upwardly along the entire length of a track 47 having a bottom 46 and an inner wall 48. The track 47 begins at the bottom 46 and extends in a spiralling manner to the top of the feeder 28 into the powder feeder exit area 58. As best illustrated in FIG. 12, the track 47 is angled slightly toward the inner wall 48 so as to keep the powder material 38 on the track 47 moving toward the powder feeder exit area 58.

The flow of powder material 38 from the feeder 28 can be regulated by varying the rate of vibration of the feeder 28 alone or in combination with an optional flow rate control device. An example of such a device consits of a deflector 97 adjustably attached to a boss 93 in the exit area 58 of the feeder 28 by a screw 99. Both the height and the angle of deflector 97 in relation to the track 47 are adjustable. Deflector 97 serves to limit the flow of material 38 vibrated along the track 47 to the exit area 58. Deflector 97 accomplishes this by directing substantially all of the material that extends above the bottom of the deflector 97 onto the slide 95. Slide 95 is secured to the inside of the feeder. The slide 95 then guides material 38 deposited thereon to the bottom 56 of the feeder 28 in order to again be vibrated along the track 47 to the exit area 58. The remaining material 38 that passes by the deflector 97 then drops down the powder feeder delivery tube 60 and down the powder delivery chute 62 under the force of gravity alone, to be deposited onto fasteners 12 as previously described in detail.

The powder feeder delivery tube 60 can be a standard pipe that allows a narrow path of delivery to the powder chute 62 and is wide enough so as to be connected to and accept and direct all of the powder material 38 leaving the powder exit area 58, down the tube 60 without impediment. A ⅛" thick copper tube has seen found particularly useful for this purpose. The adjustable powder chute 62 is connected to the end of the tube 60 furthest away from the powder exit area and can be made of any rigid material and preferably has a smooth surface or has been treated with a non stick material in order to allow free fall of the powder material 38 onto fasteners 12. The width of the chute 62 may vary with the most preferable chutes being on the order of one to three inches wide.

This unique powder feed system affords several advantages to the present invention. It has been found that, for example, if the powdered material that is used is Nylon 11, that the vibratory action of the feeder 28 that the material 38 encounters along the entire spiralling track 47 from the bottom 56 to the top of the feeder 28 tends to substantially keep the material 38 from agglomerating. In addition, this action also tends to separate substantially all of the particles that may have joined together as a result of the presence of foreign materials on the surface of the particles or other reasons by the time the material 38 exits the feeder 28.

As a result, the powder exited from the feeder 28 through the chute 62 onto the fasteners does not require a combination with an airstream, as do most prior art systems of this type. In addition, a particularly uniform flow of powder is maintained, virtually eliminating the pulsing action found in many prior art recirculating powder systems that require an airstream to be combined with the powdered material. A more uniform and consistent application of powdered material 38 to the fasteners 12 is thereby accomplished leading to more economical efficient patch application and powder utilization.

Powder flows in accordance with the present invention are in the range of 80–400 grams/minute with the most preferred range being around 350 grams/minute. The powder feed system of the present invention affords yet another advantage over the prior art systems. The powder application and the ability to locate material 38 on the threads 13 of fasteners 12 prior to heating has been found to be so consistent so as to allow a cost savings through elimination of some or all of the epoxy minor constituent used in most nylon powder coating systems without a substantial reduction in terms of adherence and torque values of the patch 14 formed on fasteners 12. Additionally, it should be understood that the thermoplastic material 38 used in conjunction with the present invention could be any type of thermoplastic including nylon, nylon epoxy resins and Teflon compounds.

Figure 10:
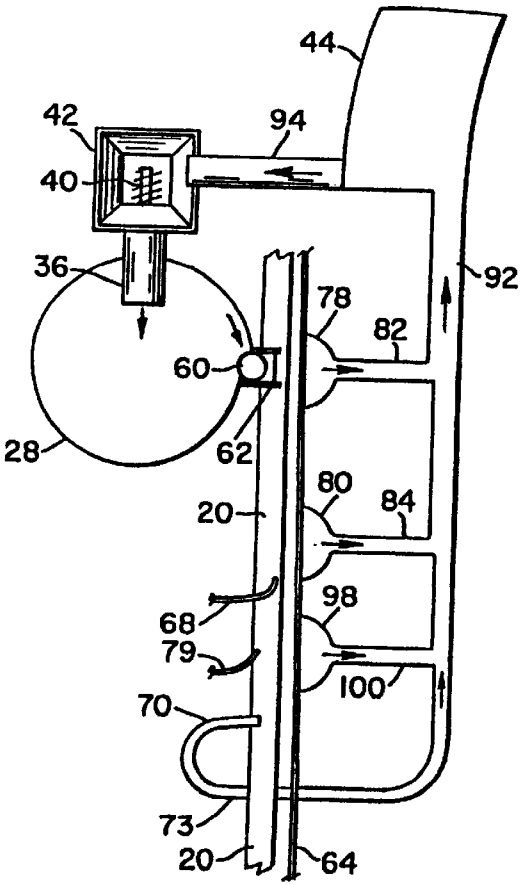
FIG. 10 is a diagrammatic view of the path of the recirculating powder feed system in accordance with an embodiment of the present invention.

As illustrated in FIG. 10, the powder feeder 28 and powder supply bin 42 form two important parts of the recirculating powder system 96 of the present invention. As previously described, the powdered material 38 is applied to fasteners 12 through chute 62 in an amount in excess of that required to form the desired patch 14. At each point along the conveyor belt 20, where excess powder material 38 is removed, such as through nozzle 78 and tube 82, nozzle 80 and tube 84 and tube 73, the powdered material 38 is directed into the powder recirculation conduit 92. The powdered material 38 is then directed from the conduit 92 into a recirculating powder supply 44 where it is combined with powder material 38 that has not previously been recirculated and is supplied through a recirculating powder connector 94 to the powder supply bin 42 for ultimate deposit into the bottom 56 of the feeder 28. This recirculating powder system 96 allows for efficient and economical usage of powder.

In addition, since in accordance with the present invention, all material 38 is applied and excess material is removed prior to any application of heat to the fasteners 12, none of the material 38 that is recirculated or ultimately applied is ever in a previously melted state or fused by heat to other powder particles prior to formation of the patch 14. Likewise, when heated plated fasteners commonly exude smoke that contains moisture and oil. Since the vacuum nozzles of the recirculating powder system of the present invention remove powder from unheated fasteners, the nozzle and powder system do not ingest any moisture and oil filled smoke into the powder system. This leads to an improvement in both resuability and the consistency in quality of the powder flow of the present invention to the fasteners 12. Although the recirculating powder system described above is particularly preferred it should be understood that other recirculating systems such as using the conduit 92 to direct material into a separate bin that is then manually deposited into the powder supply bin 42 at regular intervals could also be used.

The following examples are given to aid in understanding the invention and it is to be understood that the invention is not limited to the particular procedures or other details given in the examples.

EXAMPLE 1

Zinc plated flange nuts, ⅜"—16 were deposited with at least a portion of one of the faces of the nut resting on the conveyor belt as shown in FIG. 3 with the bottom of the threaded surface being substantially parallel to the belt. The belt speed was 13.25 feet/minute resulting in the nuts being fed at approximately 160 pieces/minutes. The nuts were introduced onto the belt at an initial angle between 10° to 12° from vertical with the spacing between the belt and the guide bar being 0.210 inches. The powder supply was adjusted to 100 grams/minute of a mixture of approximately 90% nylon powder and 10% of thermosetting epoxy resin having the following particle size distribution:

10% less than 78 microns

50% less than 165 microns

90% less than 287 microns mean=174 microns

The powder used was nylon 11 sold under the tradename of Duralon JM by Thermoclad, Inc. As the nuts moved along the belt the spacing between the belt and guide bar increased to 0.260 inches and the angle of the nut to the belt was approximately 15° to 20° from vertical. The powder was delivered to the nuts from the powder chute at approximately a 45° angle. As the nuts continued down the conveyor belt, they encountered eight nozzles, four of which were vacuum nozzles utilizing two inches of mercury and four of which were blow-off or affirmative air flow nozzles utilizing approximately 40 psi of air pressure. The location of the nozzles was as set forth below in order of their upstream to downstream location, along with an indication of whether they were in front of or behind the fastener traveling down the conveyor:

1. lower belt vacuum slotted nozzle (front underneath)
2. upper belt blow-off—nozzle with rows of 132 inch holes (front)
3. parts blow-off—⅛" copper tube (front).
4. upper belt blow-off underside of belt—⅛" copper tube (front)
5. last thread vacuum—⅛" copper tube (front)
6. nut face vacuum—⅛" copper tube (front)
7. lead thread vacuum—⅛" copper tube (rear)
8. lower belt blow-off—⅛" copper tube (front)

Once the excess nylon material was removed and remaining material was shaped, the nuts were passed through a 15 kilowatt induction heater set at 200 kilohertz (88% setting) and the nuts were raised to a temperature of approximately 620° F. it was observed that the nylon material was fully softened and melted resulting in adherence and coalescing of a plastic body in the form of a patch on the bottom of the threaded hole with approximately 60° to 75° of circumferential coverage of three threads. After cooling the applied coating was found to be uniform and to follow the contours of the threads effectively. Torque tests then were carried out with ⅜"—16 bolts. The "First on", "First off"and "Fifth removal" torque values expressed in inch pounds are set forth below:

| | First on | First off | Fifth removal |
|---|---|---|---|
| 1. | 79 | 58 | 19 |
| 2. | 95 | 62 | 22 |
| 3. | 94 | 64 | 29 |
| 4. | 98 | 79 | 30 |
| 5. | 94 | 81 | 21 |

EXAMPLE II

A second group of zinc plated flange nuts ⅜"—16 were deposited with at least a portion of one of the faces of the nut resting on the conveyor belt as shown in FIG. 3 with the bottom of the threaded surface being substantially parallel to the belt. All of the parameters set forth in Example I were identically reproduced except that the powder coating material used was a substantially pure nylon powder that contained a small amount of titanium dioxide pigment. The powder mixture contained no epoxy resin. The powder had the following properties:

POWDER PROPERTIES at least 99% less than 90 microns

100% less than 250 microns

| COATING PROPERTIES | |
|---|---|
| Specific gravity | 1.04 |
| Melting point, DSC Peak | 186–188° C., |
| Abrasion Resistance, Tabor 1000 Cycles, 1 Kg. load, CS17 wheels | 5–8 Mg. |
| Impact resistance, Gardner 160 in.-lbs | No failures |
| Salt spray, ASTM B117 | >1000 hours |

The powder used was French Natural ES Nylon 11 coating powder sold by Elf Atochem North America, Inc. Similar results in terms of appearance, melting, adherence and coalescing of a plastic body in the form of a patch on the bottom of the threaded hole of approximately 60–75° of circumferential coverage of three threads in comparison to Example I were observed. Similarly, after cooling, the applied coating was found to be uniform and to follow the contour of the threads effectively. Torque tests were then carried out with ⅜"—16 bolts. The resulting "First on", "First off" and "Fifth removal" torque values expressed in inch pounds are set forth below:

| | First on | First off | Fifth removal |
|---|---|---|---|
| 1. | 76 | 57 | 25 |
| 2. | 92 | 70 | 20 |
| 3. | 78 | 52 | 21 |
| 4. | 84 | 66 | 25 |
| 5. | 71 | 64 | 22 |

The resulting torque test values on nuts that utilized the substantially pure nylon coating powder compared quite favorably to the torque tests values on nuts from Example I that utilized the nylon powder that contained a 10% epoxy resin constituent.

From these examples, the use of different types of coating powders in connection with the powder feed system, conveyor, heating and air nozzle configurations of the present invention was demonstrated to produce very effective results.

We claim as follows:

1. A method for applying a locking element of thermoplastic material to a succession of internally threaded articles having open ends to the threaded portion thereof and an axis running along the threaded portion between said open ends, comprising the steps of:

conveying said threaded articles on support in a path for treatment with the axes of their threaded portions in a substantially horizontal position and with each of the open ends at the threaded portions at least partially uncovered to permit a passage of an amount of thermoplastic material through said open ends;

directing a stream of thermoplastic material onto and around an area of said threaded portions in a sufficient amount needed to form said locking element; and thereafter heating said threaded portions of said threaded articles to a temperature above the softening point of the thermoplastic material to be applied.

2. The method of claim 1, wherein, said conveying step includes supporting said threaded articles in two distinct planes along their entire path for treatment.

3. The method of claim 1, wherein, said directing step is carried out under the force of gravity alone.

4. The method of claim 1, further comprising the step of:

collecting the thermoplastic material collected in said removing step.

5. The method of claim 4, further comprising the step of:

recirculating the thermoplastic material collected in said collecting step.

6. The method of claim 5, wherein said recirculating step is completed by directing said thermoplastic material onto and around an area of the threaded portions of articles other than those that said material was collected from in said collecting step prior to heating said articles.

7. The method of claim 1, wherein, said removing step is carried out by a plurality of airstreams.

8. The method of claim 1, wherein, said conveying step includes partially rotating the threaded articles along their entire path for treatment, such that the axes of their threaded portions continuously move further away from a substantially horizontal position as they traverse said path.

9. The method of claim 1, wherein said thermoplastic material is a heat fusible resin.

10. The method of claim 1, wherein said thermoplastic material is nylon.

11. A process of directing a heat fusible resin onto the threads of an internally threaded article having openings at both ends and an axis along said threaded portion between said openings to form a locking element, comprising the steps of:

conveying said threaded article on a support in a path for treatment with the axis of their threaded portions in a substantially horizontal position and with a portion of each of said openings uncovered;

directing a continuous uninterrupted stream of heat fusible resin onto and around an area of said threaded portion in an amount in excess of the amount needed to form said locking element;

removing the amount of heat fusible resin in excess of the amount required to form said locking element from around the area of said threaded portion from said threaded portion of said articles; and thereafter heating said threaded portion of said threaded article to a temperature above the softening point of the heat fusible resin to be applied.

* * * * *